US007059236B2

(12) United States Patent
Gonzalez

(10) Patent No.: US 7,059,236 B2
(45) Date of Patent: Jun. 13, 2006

(54) APPARATUS AND METHOD FOR BALLISTIC PROTECTION OF VEHICLE UNDERCARRIAGES

(75) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 142 days.

(21) Appl. No.: 10/885,390

(22) Filed: Jul. 7, 2004

(65) Prior Publication Data

US 2006/0048641 A1 Mar. 9, 2006

(51) Int. Cl.
*F41H 7/02* (2006.01)

(52) U.S. Cl. ..... 89/36.08; 89/36.09; 89/1.13; 89/1.11

(58) Field of Classification Search ..... 89/36.07, 89/36.08, 36.09, 1.13, 1.11
See application file for complete search history.

(56) References Cited

U.S. PATENT DOCUMENTS 5,786,542 A * 7/1998 Petrovich et al. ..... 89/1.13
6,477,934 B1 * 11/2002 Bruhn et al. ..... 89/36.08
6,779,431 B1 * 8/2004 Honlinger ..... 89/36.08
6,892,622 B1 * 5/2005 Watson ..... 89/1.13
2004/0035285 A1 * 2/2004 Renwick et al. ..... 89/1.13

* cited by examiner

*Primary Examiner*—J. Woodrow Eldred
(74) *Attorney, Agent, or Firm*—David L. Kuhn; Luis Miguel Acosta; Thomas W. Saur

(57) ABSTRACT

An elongate ballistic protection apparatus is described and claimed herein which has minimal weight and maximum flexibility to conform to the most contorted and undulating ground surfaces. In use, it is immediately positioned below a military vehicle to protect the crew compartment positioned above said apparatus by extending transversely between the propulsive means and laterally along the direction of travel for the vehicle. The apparatus may detonate mines while operated by driven engagement over mine bearing terrains, but it will do so in a manner sufficient to defeat them without inducing unacceptable damages to either the vehicle or crew.

Thereby, this invention provides a means to effectively disrupt the firing sequence of the explosive charges in these mines by contact with my minimal weight roller link chain. Beneficially, the blast gasses and ejecta of the mine simply vents through the open areas of my chain. This is a substantial improvement over devices having solid configurations or geometries.

12 Claims, 4 Drawing Sheets

APPARATUS AND METHOD FOR BALLISTIC PROTECTION OF VEHICLE UNDERCARRIAGES

GOVERNMENT INTEREST

The invention described herein may be made, used, and licensed by, or for, the United States Government for governmental purposes without paying me any royalty.

BACKGROUND AND SUMMARY

This invention pertains to an apparatus and method for the ballistic protection of military vehicle undercarriages which may be vulnerable to the blast effects of explosive devices, such as antivehicular (A/V) mines, shaped charges, and blast mines. As used herein, the term "military vehicle" comprises a variety of armored personnel carriers, tanks, and tactical vehicles.

The belly or underside of these vehicles are manufactured with less protection in this area and are often pierced or otherwise damaged by explosive devices that are deployed on, or slightly below ground level, of a typical battlefield to impede the ground mobility and support capability of an opposing army. An improved apparatus and method for the ballistic protection of military vehicle undercarriages are needed to defeat these explosive devices, especially in view of an ever increasing threat level.

One particular threat is a mine that upwardly launches an explosively formed and propelled projectile into the belly or undercarriage of a target vehicle to either disable the vehicle and/or injure its crew. These mines are commonly known as shaped charge (SC) mines, and include Explosively Formed Penetrator (EFP) mines as a subcategory. These mines can forcefully penetrate the armor found on the bottom of most military vehicles; because it is substantially less than the armor used on most vehicle perimeters. It is further recognized that a formed projectile of an EFP mine has a smaller length to diameter ratio than those produced by SC mines which form a thin "jet" stream.

SC mines employ two explosive charges that must fire in a close sequence, or the mine could be ineffective. Thus, the first blast will act as a clearing charge to remove any soil or debris covering the mine. Then, the next blast will cause jet or EFP formation to yield a subsequent penetration capability by said mine for the vehicle undercarriage.

A past strategy for defending against SC mines has been to prevent jet or EFP formation by interrupting soil and/or debris removal by the initial charge. A field-expedient has been developed by tank crews to accomplish this affect. In a first aspect, the protective capability of a vehicle's bottom armor was enhanced by the use of an armor drag plate suspended below the tank and drug along the ground surface. While ingenuity in the field is common for our soldiers, their effort has been met with only mixed results. While this approach has successfully averted jet or EFP formation by its sheer weight, it has also had other vulnerabilities and liabilities.

For example, several mobility problems were encountered with the drag plate approach. The first is the significant resistance of the plate to being dragged along an undulating ground surface which consumes both power and fuel. A second problem is the amount of weight required for the drag plate to prevent soil/debris removal by the initial clearing charge. Ironically in certain circumstances—like when the mine is at or very near the surface—the drag plate may prevent EFP formation, but the explosives can act in such a manner to cause EFP creation in the armor plate itself to thereafter punch through said plate and pierce into the bottom of a vehicle. Moreover, the solid configuration of the plate restricts venting of any explosion or blast effect, thereby exacerbating the effects of blast mines. When all these things are considered, we find that the disadvantages of the drag plate expedient far outweigh its advantages.

I provide herein a method and apparatus to effectively and efficiently prevent EFP formation. My inventive structure incorporates a multitude of small wheels or rollers, within a spatially arranged link chain, to establish a continuous rolling contact with the contours of the ground. This flexible and open matrix structure successfully prevents EFP formation itself, as compared to the efforts of others who rely on the sheer weight of armor plates to disrupt mine sequences. My chain is superior to a drag plate approach because it significantly reduces the forces needed to pull it across a terrain while simultaneously binding all chain components into a secure protective device that decreases consumption of vehicle tractive power and also conserves fuel.

My chain also provides a plurality of vents or voids that are arranged and separated by one or more chain links or rollers to maintain an open mesh or grid within my apparatus. This lighter and open structure readily vents blast forces generated underneath the military vehicle that are caused by mine or explosive device detonations. Thereby, tractive force requirements are reduced; potential mobility problems are minimized; and blast pressures, ejecta, and other debris will simply pass through my claimed structure. The consequent mobility, flexibility, and/or survivability of my apparatus are surprising in comparison to any previously used drag plate. Moreover, my roller link chain is considerably lighter than a drag plate, and it more effectively impairs EFP formations as compared to blast suppression of soil and debris.

My apparatus can be suitably dimensioned, as to length and width, for convenient deployment below the undercarriage of various types of modern military vehicles in such a manner to specifically afford ballistic protection to the crew compartment. This is accomplished when said chain is longitudinally extended parallel to the direction of travel, while transversely fitting between the propulsive means of the vehicle, and laterally extending manner below the crew compartment to be protected.

Since my invention is extremely light and flexible, it has an excellent conformance to the most contorted and undulating of ground surfaces that are encountered in military and peacekeeping operations. Thus, my EFP roller chain will always be in close contact with the traversed terrain.

Further, the features and advantages of my invention are highly effective as compared to any previous approach. The specific geometry and spatiality between the links and wheels of my roller chain reduce its chances of ever forming an EFP. While various chain segments or parts may conceivably become secondary projectiles, their maximum dimensions and possible lethality are generally limited to less than the link or wheel size. Thus, these explosively launched roller chain parts would prove a minimal hazard to a vehicle bottom that is already designed to withstand most explosive blasts.

It is therefore an object of this invention to provide the art with an apparatus and method for ballistic protection of undercarriages of military vehicles. It is a separate object for these to be simple, reliable, and durable.

These and other objects, features, and advantages of this invention will be apparent to those skilled in the relevant arts upon a full reading of this specification and the appended claims which explain and define the aspects and principals of this invention.

DETAILED DESCRIPTION

Figure 1:
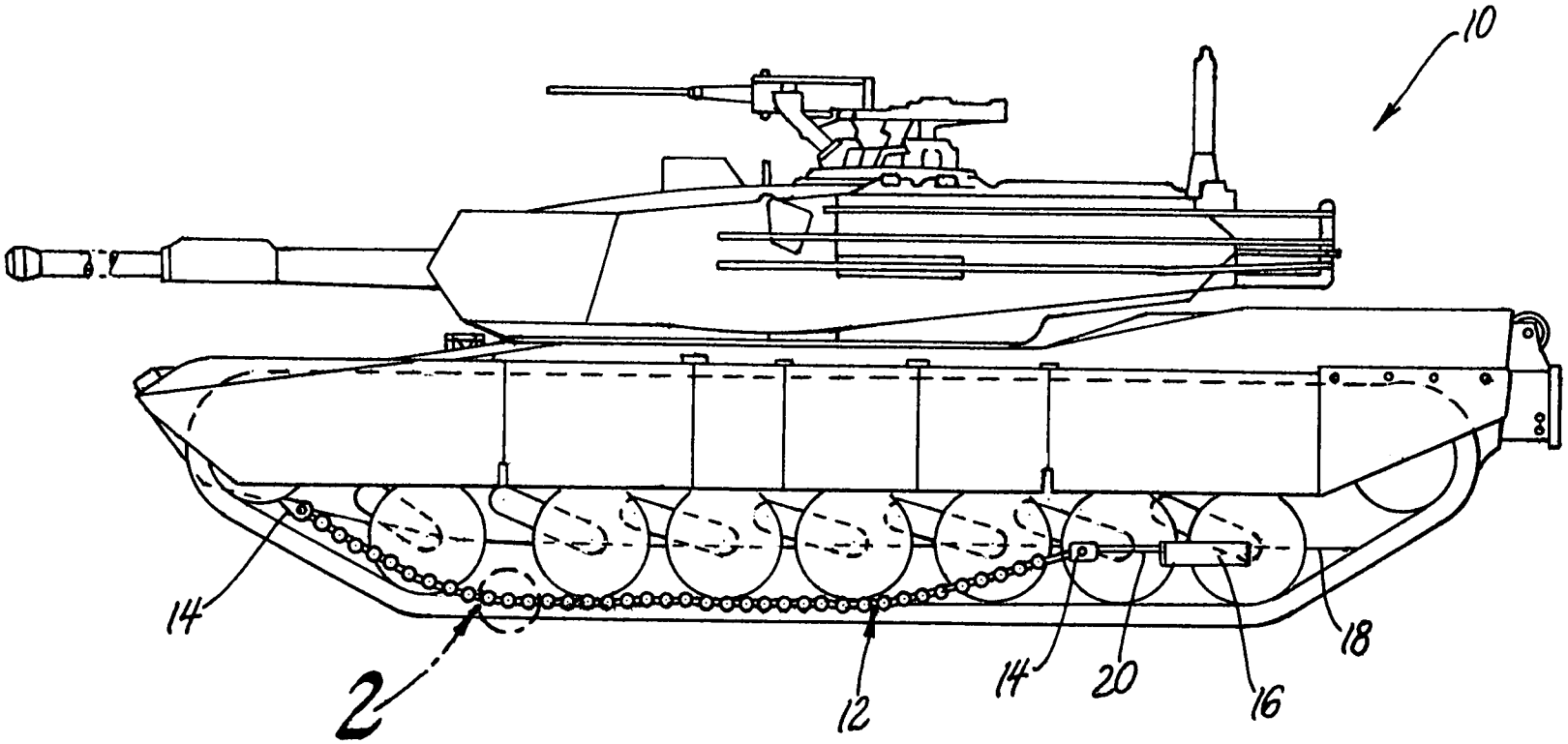
FIG. 1 is a tank side view depicting this invention in its deployed position against a flat terrain.

According to my invention, and referring to FIG. 1, there is shown therein my roller link chain 12 for shaped charge mines that is attached to any suitable supporting surface on the tank 10. For example, front and rear assemblies 14 on the undercarriage are depicted in this Figure. This chain has sufficient strands and rows of rollers embedded within chain links for it to protect the area between the tracks of said tank and also extend from the front to rear of a crew compartment within the tank. While tracks are both shown and described above, my apparatus will work just as well with wheeled military vehicles, such as those enumerated in paragraph [0002].

As shown therein, my invention is deployed in a lowered position with the claimed chain structure positioned over a relatively flat ground surface. The protected area above the chain structure (the tank belly) conforms substantially to the crew compartment. This area is most in need of protection.

In FIG. 1, the front and rear assemblies 14 for receiving and retaining my roller chain to the military vehicle 10 are generally depicted as four attachment points on its underside. While the right side is not shown, it is to be understood as essentially a mirror image of the left side. This arrangement will limit the need for crew dismounts to install or remove this chain. Typical examples of front and rear assemblies are a mounting lunette, pivot, flange, fork, lug, bracket, eyelet, clevis, and yoke that is directly welded to the hull for receiving the respective (front and rear) ends of my roller link chain.

Each link (A or B) has opposing bores 26 at its ends. In an assembled roller chain, these bores will be filled or interconnected by pivots, pins, rods, clevises, threaded fasteners, and like elements of conventional nature that are capable of being grasped at the forward and rear ends of my chain. It is essential that the chain and front or rear assemblies be attached to the protected vehicle without significant modification or any penetration that might impair hull integrity.

If desired, the rear assembly 14 on the vehicle's left side can be replaced with a simple actuator 16, or similar device, that is directly affixed, such as by welding, to the undercarriage 18. This actuator will be used to raise, lower, and tension my roller link chain dependent upon the encountered conditions. Examples of suitable actuator devices are selectable from the group consisting of pneumatic, hydraulic, and electric types. When the actuator ram 20 is extended toward the vehicle front, my chain is lowered to its ballistic protection position. When said ram is reversed, or retracted, my roller chain is tensioned and pulled from the ground to be conveniently tucked away in the undercarriage area of the tank and between its tracks. This latter position is the routine, day-to-day, location for operation of my invention to avoid drag forces and to conserve fuel. This also extends the life of the device and the vehicle.

My roller chain is deployed and operated only when the need for ballistic protection occurs, such as a minefield. It is anticipated that the fixed front assemblies and the right-side rear assembly will be sufficient for use of my roller chain on the vehicle in conjunction with actuator 16 on the left rear-side. Accordingly, I have shown the ram end 20 of the actuator 16 as a separate rear assembly means 14, even though the actuator housing is the object actually affixed to the vehicle. If increases in chain weights are necessary for provision of suitable ballistic protection, one can alternatively use stronger or even dual rear actuators to tension and lift my invention to the vehicle's underbelly.

Figure 2:
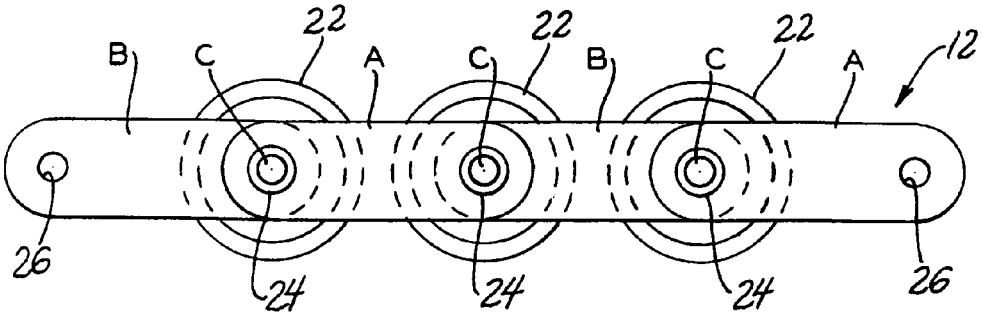
FIG. 2 is an enlarged view in plan of FIG. 1 taken at reference point 2.

FIG. 2 is taken from reference point 2 of FIG. 1 to yield an enlarged plan view of my EFP roller chain 12. This view is taken between the road wheels 3 and 4 with number initiation starting at the partially depicted first road wheel, or idler. As shown therein, this chain segment contains just three identically numbered rollers, or wheels 22, which are dimensionally spaced apart from each other and from surrounding links that will act as retainers or keepers.

Figure 3:
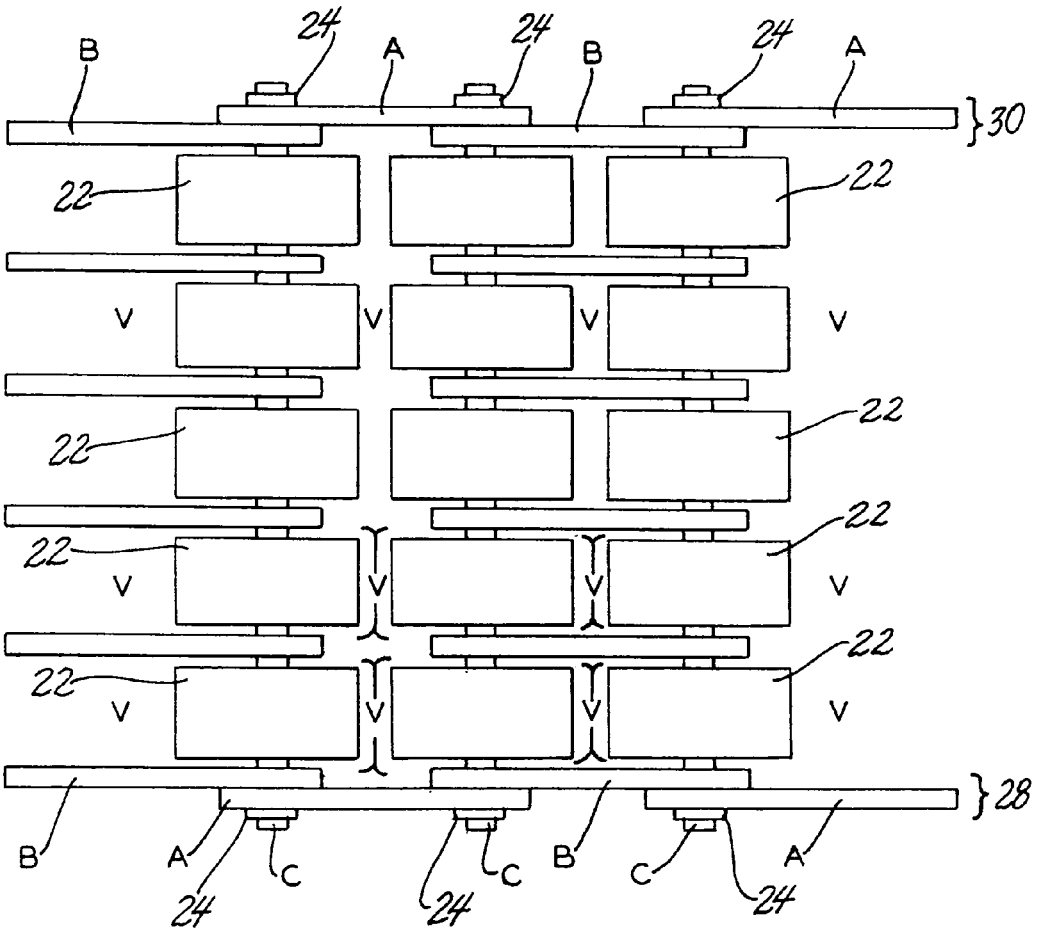
FIG. 3 is a top view of FIG. 2 showing this invention with the vehicle removed.

As generally shown in FIG. 2, and better understood in FIG. 3, each link plate A or B is identical, and these links zigzag in the two outermost horizontal rows 28 and 30 to share between them two rollers 22 each. Thereafter, the internal links of FIG. 3 are in a simple pattern of all B links. The interfacing means between the apparatus and the front and rear assemblies are chosen from the following: adhesives, weldments, studs, rivets, washers, cables, slings, collars, clips, cotter pins, and clevises. The materials of construction for the front, rear, and interface assemblies, as well as the chain retention means, include hard materials, such as armor steel, alloys of iron, other metal alloys, plastics, composites, and plastic-reinforced natural and synthetic fibers.

While the exact length and number of vertical strands of my roller link chain are not fixed, it is understood to be that which will adequately provide sufficient dimensions to safely extend laterally below the compartment for the crew and between the propulsive means of the military vehicle. No more or no less in length or width. Thus, more or less strands and rows may be required for any particular vehicle than is depicted within FIG. 3 which shows a simple apparatus of three vertical strands and five rows for my roller link chain. This figure also indicates the open areas V of my chain necessary to pass or vent blast gases, soil, debris, and other ejecta coming from the ground and passing through said chain.

Suitable dimensions for the links A and B are about 5.0 inches in length by about 2.25 inches in width by a thickness of about ⅜ of an inch. While not specifically limiting, the general dimensions of the wheels 22 are about 2 inches in width by about 4 inches in diameter with axles of about 0.5 inch diameter. These rollers are simple assemblies that comprise an outer tire which has been molded onto a hub having a shaft, or axle, C that concentrically passes through the wheel center. For purposes of illustration, assume that the tire is polyurethane, the hub is polypropylene, and the shaft is metal alloy. It should be also understood that other materials with similar properties as those mentioned above are just as suitable herein. The shaft C extends into, and is held within, opposing apertures or bores 26 that are borne at opposing ends of the links A or B. Thereby, my roller chains are suitable for close and rolling engagement with the contours of the ground.

The shafts C have sufficient length and diameter to allow the wheel to revolve within bores 26 while also being retained between outboard horizontal rows 28 and 30 of the chain. Chain retention means 24 are applied over the shafts C and against the exterior faces of the most outer links A. This design provides additional overall reliability to the roller chain assembly by axially securing all of the components. As shown within FIGS. 2 and 3, the outermost forward links are B links that extend to the left, and the rearward most links are A links that extend to the right. Examples of chain retaining means 24 which are contemplated for herein are threaded fasteners, cables, slings, washers, collars, clips, cotter pins, clevises, adhesives, studs, weldments, rivets, and the like.

Figure 4:
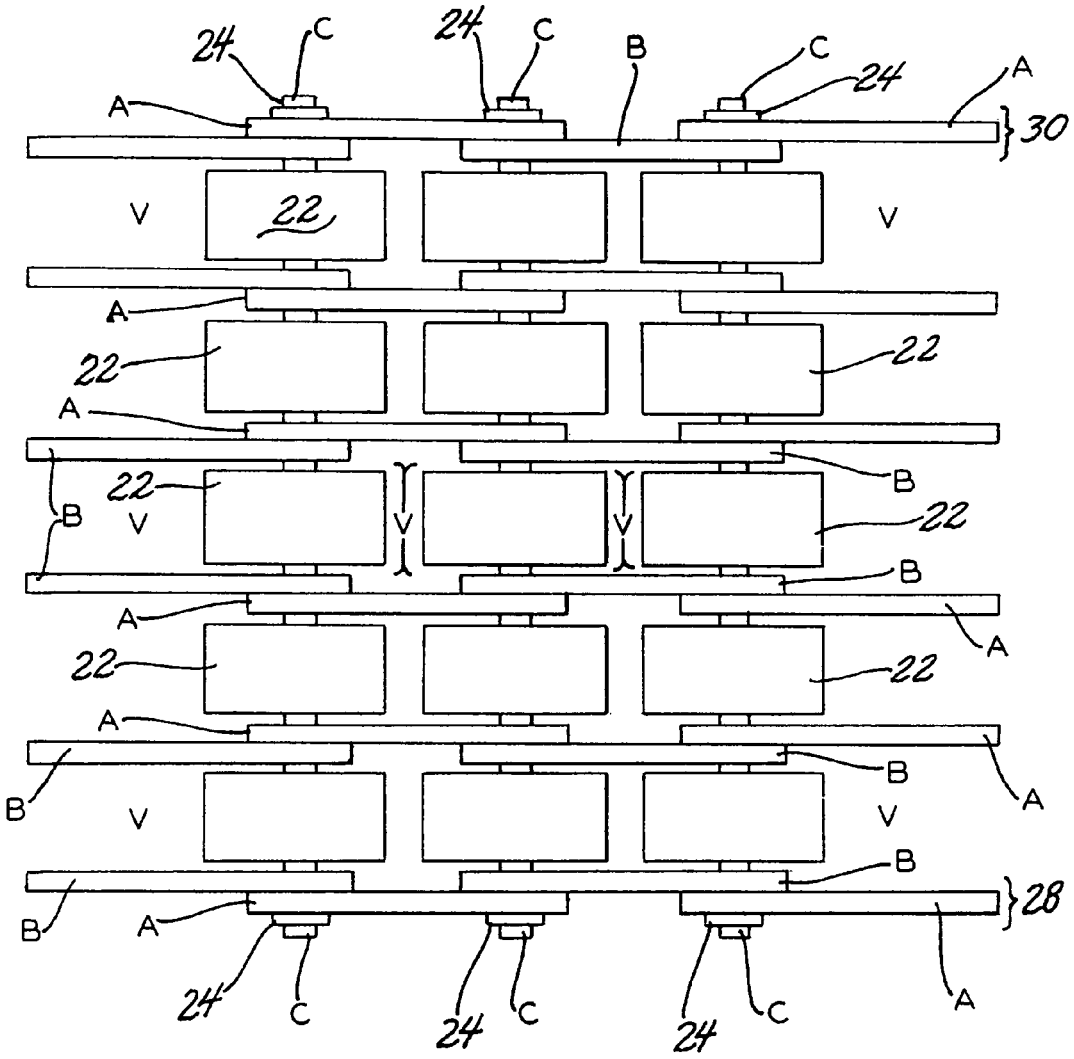
FIG. 4 is a top view of a variant of FIG. 3 in which a zigzag arrangement of links is employed throughout this roller link chain.

FIG. 4 shows a more complex arrangement within the interior of my chain with zigzag A and B links in the outermost rows of my chain 28 and 30. However, within the remainder of the chain interior are alternating pairs of B links and A links that secure a pair of rollers alternatingly within a single strand extending transversely to the direction of travel of the support vehicle. Again, the outermost forward links are B links that extend to the left, and the rearward most links are A links that extend to the right. In this particular configuration, there are more chain links extending to the rear than in FIG. 3.

Figure 5:
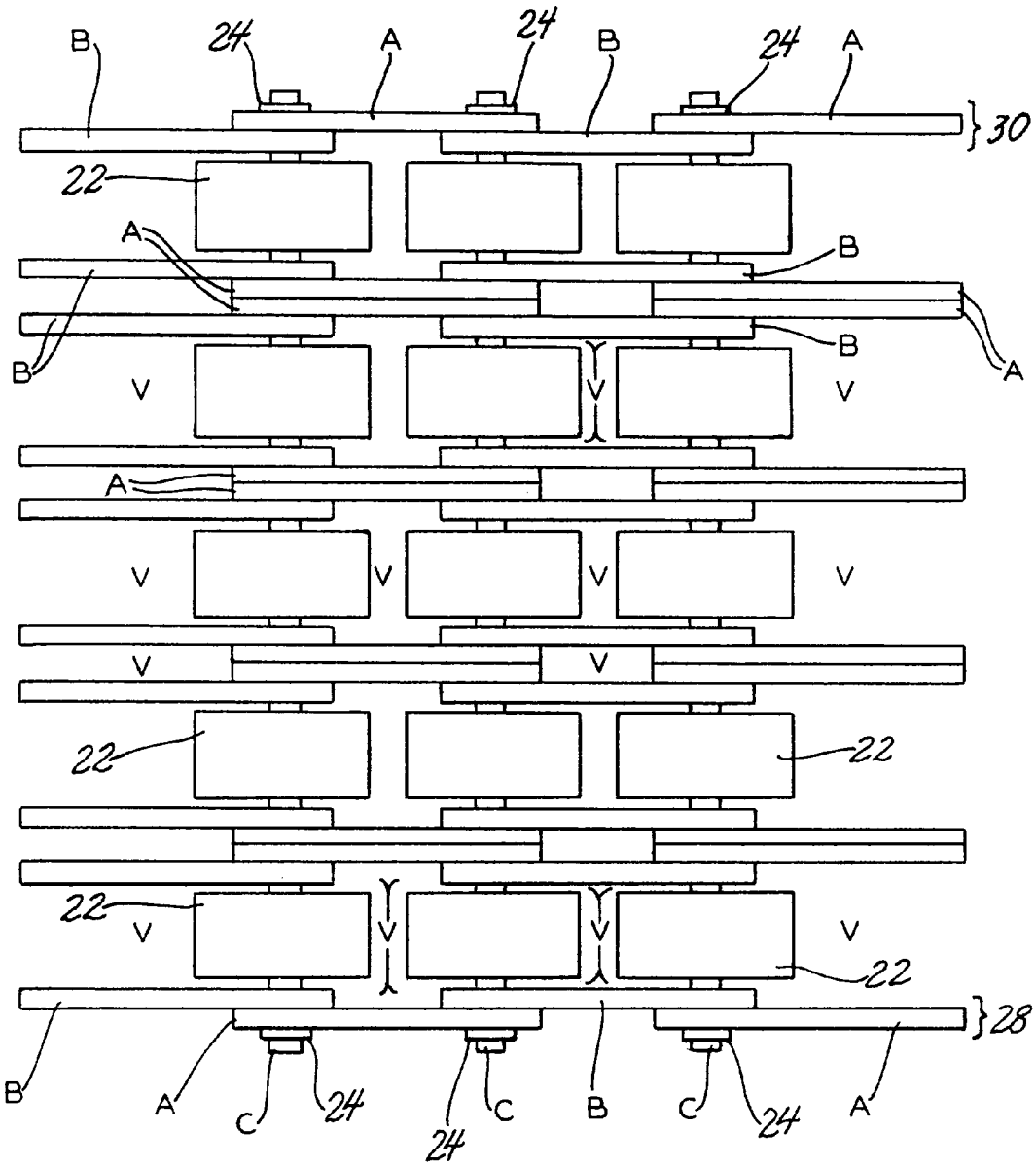
FIG. 5 is a top view of a variant of FIG. 3 showing this invention as a reinforced apparatus with additional links for more strength.

FIG. 5 is yet another variant, similar to FIG. 4, in which the A and B links in the interior of the chain are doubled to provide reinforcement and greater strength to the entire chain.

As described and shown above, the unique features and effects of my EFP roller chain invention have been disclosed. By virtue of a matrix construction, it has excellent capabilities of flexibility, relief of blast and debris events, and continual rolling contact with uneven terrain. Moreover, the zig-zag mounting structure gives it a 3-dimenstional aspect to flex on even the roughest of terrains which capturing all elements within the chain.

It will readily be seen to those skilled in the art that the invention herein will fulfill all of the objects and will yield all benefits enumerated above. I wish it understood that I do not desire to be limited to exact methods or details of construction disclosed herein since simple variants, small changes, and obvious modifications of my invention may occur to those of ordinary skill without a departure from the spirit and scope of my claims.

What is claimed is:

1. A vehicle-mounted ballistic protection apparatus of generally elongate configuration comprising:

a. a military vehicle having thereon front and rear assemblies for mounting said apparatus below its undercarriage in either forward and rearward directions of travel;

b. interfacing means on said apparatus to cooperatively mate with the front and rear assemblies on said vehicle thereby deploying the apparatus below the vehicle and longitudinally extending said apparatus between vehicle propulsive means during travel to thereby afford ballistic protection to the vehicle crew compartment; and c. a plurality of rotating rollers for continuous terrain contact embedded within a multiplicity of links having bores at opposing ends of each link for rotationally receiving axle ends of said rollers between alternating links and thereby flexibly holding together said rollers and links by placement of chain retention means over said axle ends and against exposed outboard link faces to achieve a flexible roller link chain pivotally held together.

2. The ballistic protection apparatus of claim 1 wherein said propulsive means is selected from the group essentially consisting of wheels and tracks.

3. The ballistic protection apparatus of claim 1 wherein said front and rear assemblies are selected from the group consisting essentially of a mounting lunette, pivot, flange, fork, lug, bracket, eyelet, yoke, and clevis.

4. The ballistic protection apparatus of claim 1 wherein said interfacing means is selected from the group consisting essentially of threaded fasteners, cables, slings, washers, clips, cotter pins, clevises, adhesives, weldments, rivets, and studs.

5. The apparatus of claim 1 wherein said chain retention means is selected from the group consisting essentially of threaded fasteners, cables, slings, washers, collars, clips, cotter pins, clevises, adhesives, studs, weldments, and rivets.

6. The apparatus of claim 1 wherein said interfacing means is selected from the group consisting essentially of threaded fasteners, cables, slings, washers, clips, cotter pins, clevises, adhesives, weldments, rivets, and studs.

7. The apparatus of claim 1 wherein said link plates, axles, assemblies, interfacing means, and chain retention means are made of a hard material.

8. The apparatus claim 7 wherein said hard material is selected from the group consisting essentially of armor steel, alloys of iron, and other metal alloys.

9. The apparatus of claim 1 wherein the rotating rollers comprise an outer polyurethane tire that has been molded about a hub of polypropylene having a steel shaft that concentrically extends through the roller.

10. The apparatus of claim 1 wherein the rear assembly on the left side of the vehicle is replaced with a simple actuator that is directly affixed to the undercarriage, and is used to raise and lower said apparatus.

11. The apparatus of claim 10 wherein the actuator is selected from the group essentially consisting of pneumatic, hydraulic, and electric actuators operable from inside the vehicle.

12. Method for ballistic protection of vehicle undercarriages comprising the steps of:

a. producing an apparatus comprising a plurality of rotating rollers for continuous terrain contact embedded within a multiplicity of chain links having bores at opposing ends of each link for rotationally receiving therein axle ends of said rollers between alternating links to thereby flexibly hold together said rollers and links with placement of chain retention means over said axle ends and against outboard exposed link faces to achieve a flexible roller link chain pivotally held together;

b. preparing interfacing means on said apparatus to cooperatively mate with the front and rear assemblies on said vehicle thereby deploying the apparatus below the vehicle and longitudinally extending said apparatus between vehicle propulsive means during travel to thereby afford ballistic protection to the vehicle crew compartment; and c. furnishing a military vehicle having thereon front and rear assemblies for mounting said apparatus below its undercarriage in either forward and rearward directions of travel.

* * * * *